United States Patent [19]

Kuehnle et al.

[11] 4,338,018

[45] Jul. 6, 1982

[54] LIGHT SCANNING ASSEMBLY FOR ELECTROPHOTOGRAPHIC PRINTING PLATE MAKING APPARATUS

[75] Inventors: Manfred R. Kuehnle, New London, N.H.; James C. Compton, Marlborough, Mass.

[73] Assignee: Coulter Systems Corporation, Bedford, Mass.

[21] Appl. No.: 139,465

[22] Filed: Apr. 11, 1980

[51] Int. Cl.[3] ..... G03G 15/28

[52] U.S. Cl. ..... 355/8; 355/11; 355/67; 355/77

[58] Field of Search ..... 355/8, 11, 66, 77, 67, 355/70

[56] References Cited

U.S. PATENT DOCUMENTS

| | | | |
|---|---|---|---|
| 3,703,334 | 11/1972 | Knehtel et al. | 355/11 |
| 3,709,592 | 1/1973 | Kawakubo et al. | 355/66 X |
| 3,790,272 | 2/1974 | Knechtel et al. | 355/8 X |
| 3,806,239 | 4/1974 | Inoue et al. | 355/8 |
| 3,815,991 | 6/1974 | Janssen et al. | 355/66 |
| 4,007,981 | 2/1977 | Goren | 355/8 X |
| 4,111,541 | 9/1978 | Townsend | 355/8 |
| 4,189,763 | 2/1980 | Suzuki et al. | 355/8 X |
| 4,266,869 | 5/1981 | Kuehnle et al. | 355/8 |

*Primary Examiner*—J. V. Truhe
*Assistant Examiner*—Richard M. Moose
*Attorney, Agent, or Firm*—Silverman, Cass & Singer, Ltd.

[57] ABSTRACT

A light scanning assembly for apparatus including a copyboard, an optical train and a carriage carrying charging, exposure and toning devices. The copyboard is movable from a horizontal disposition to a vertical disposition at which it is scanned in synchronism with simultaneous movement of the carriage horizontally. The light scanning assembly comprises a support bracket mounting a pair of illuminating lamps disposed each with an associated elliptically configured reflector. The support bracket is driven translating the lamp pair and their common intersection band across the face of the copyboard synchronously with the movement of the carriage. A third lamp is mounted (with reflector) on a second bracket to illuminate through the copyboard and is movable vertically with the first bracket. The third lamp is energized only when a transparent document is carried by the copyboard. The first pair of lamps are not energized at that occasion. The brackets are pivotable to rotate said respective lamps and associated reflectors along a predetermined arc during the vertical translation thereof so that the light emitted therefrom is focused along a straight line continuously directed to the center of the optical train along the line representing the shortest distance to the lens so that the image always is in focus. A cam wheel on the bracket follows a canted or tapered guide surface formed on a vertically arranged leg supporting said light scanning assembly to effect pivoting of the said bracket, return of the bracket being effected solely by gravity.

17 Claims, 5 Drawing Figures

LIGHT SCANNING ASSEMBLY FOR ELECTROPHOTOGRAPHIC PRINTING PLATE MAKING APPARATUS

CROSS REFERENCE TO COPENDING APPLICATIONS

Reference is made herein to pending application Ser. No. 10,497 filed Feb. 9, 1979, now U.S. Pat. No. 4,266,869 and owned by the Assignee hereof, same being incorporated by reference herein, to provide background for the invention hereof.

FIELD AND BACKGROUND OF THE INVENTION

The invention herein is directed to an improved light scanning assembly for use in the manufacture of printing plates, particularly for lithographic use, by high speed electrostatic methods. The plates produced by the apparatus and method of the invention are superior to printing plates made by known methods whether photographically or electrostatically.

Lithographic printing plates made by the conventional photographic methods are expensive and complex; plates made by electrostatic methods which are known have never been widely used because they require considerable time to produce, have very little life and are low in resolution and spectral response. The latter two disadvantages are characteristic also of photographically made lithographic plates.

Lithographic printing is a process which is basically very old and and well-known. For many years, even well into this century, the technique was practiced on special stone surfaces. A greasy image was applied to a surface, the non-imaged portions being rendered hydrophilic (water attractive, oil repellent). The imaged parts being hydrophobic (water repellent, oil attractive) when a paper receptor is pressed against the surface which has been wetted with water and the greasy ink, the greasy ink having adhered only to the image will be transferred to the paper.

In this process, since the only difference between the imaged and non-imaged areas is the presence of ink on the imaged areas, there is substantially no difference in height between the two areas, this type printing also being known as planographic. In the case of the classic method of letter press printing the imaged areas are in relief above the non-imaged areas or intaglio, that is engraved below the non-imaged areas.

Offset lithography is probably the most important method of printing today. The principle is that ink is offset first from the plate to a rubber blanket and then from the blanket to the paper receptor. There may be an intervening metal drum instead of a rubber blanket. When the printing plate is made, the printing image is rendered hydrophobic, i.e., repellent to water but also attractive to grease. The non-printing areas are rendered just the opposite, that is, hydrophilic. On the press the plate is mounted on a plate cylinder which, as it rotates, comes into contact successively with rollers wet by a water or dampening solution and rollers wet by grease-based ink. The dampening solution wets the non-printing areas of the plate and prevents the ink from wetting these areas. The ink wets the image areas which are transferred to the intermediate blanket cylinder. The paper picks up the image as it passes between the blanket cylinder and the impression cylinder.

In order to appreciate and understand the nature and advantages of this invention, one should comprehend the problems which are a necessary adjunct to the manufacture of a lithographic plate by conventional methods.

Offset plates of conventional construction of the type expected to make many thousands of impressions are expensive to manufacture. Ink receptivity is accomplished by using inherently oleophilic (having an affinity for oil) resins or metals like copper or brass on the image areas. Water receptivity of the non-image areas is usually achieved by using hydrophilic metals like chromium, aluminum or stainless steel and this receptivity is maintained in platemaking and storage by using natural and synthetic gums such as for example, gum arabic.

All offset printing plates which are used for long runs exceeding several thousands of impressions are made by indirect imaging methods. The copy or intelligence is first required to be photographed onto silver halide film and the film negative then used to transfer the image to the printing plate. The transfer is accomplished in all such cases by means of photographic projection onto a coating which is light sensitive and carried by the plate. The negative is used to project the image onto the plate and the processes which follow for the development of the image on the plate vary. Thus, the plates are required to be stored in darkness until used or the light-sensitive coating applied just before use. This is true of the three types of long-run offset plates which are most popularly used today.

The three types of long run plates which are known at this time are surface, deep etch and bimetal. The surface plates are those in which a light-sensitive coating is exposed to a negative, developed etc. The process of achieving the plate requires many steps and treatments. On deep etch plates, after exposure to the negative, the coating in the image areas is removed and coppered chemically lacquered and inked so they are ink receptive. The plate is usually aluminum and the process is quite involved and requires considerable skill. Bimetal plates are similar to deep etch in that the light sensitive coating is removed from the image areas but these areas consist of copper or brass.

By reason of the planographic nature of lithographic plates, electrostatic techniques would seem to lend themselves to the making of such plates. The toned images on a receptor or a photoconductive surface would seem to form the basis for hydrophobic and hydrophilic areas, respectively, but until the invention of the plates of the copending applications, Ser. Nos. 887,189, now U.S. Pat. No. 4,363,367 and Ser. No. 286,609, this has not been realized. Prior attempts, as for example using a zinc oxide electrophotographic member, have not been successful.

Among the difficulties encountered have been low sensitivity, low resolution, mediocre quality, slow speed of manufacture, inability to stand up to wear on a printing press and limited chromatic response. Even conventional lithographic plates are normally exposed only with ultraviolet light and have limited chromatic response. Text and graphics must be separately produced on the plate by complex methods.

Given a metal or polyester based lithographic printing plate wherein the photoconductive coating is as disclosed in U.S. Pat. No. 4,025,339, most, if not all of the disadvantages of prior lithographic printing plates are overcome. The apparatus of the referenced patent application provided solution to an additional group of problems. These included required uniform charging over large area, exposure over the same areas which is capable of accomplishment in a reliable manner by one who is not necessarily skilled in electrostatic techniques, toning and fixing done routinely, with dispatch. The disclosed apparatus of the herein application and the referenced application, Ser. No. 10,497, now U.S. Pat. No. 4,266,869 handles copy originals (both transparencies and opaque originals) conveniently and effects the functional processes so as to enable achievement of the many attributes of the aforementioned printing plates. The apparatus provided in said referenced application Ser. No. 10,497 was easily fabricated, occupied little space, and produced uniform results at each cycle of its operation.

The apparatus described in said referenced application Ser. No. 10,497 for making lithographic printing plates directly from a copy original comprised a light-tight enclosure whose component parts perform all functions needed to deliver a plate, either fully treated and ready for mounting on a press or in condition to be treated by a single bath of etchant and thereby made ready for the press.

A copyboard was mounted horizontally at the top of a light tight enclosure at convenient location to receive a copy original thereon. The copyboard was translated swingably to a substantially vertical disposition where it was scanned progressively by a fixed lamp assembly from its face and/or its rear if the copy original is transparent.

The scanning assembly was formed of a front reflector, parabolic in configuration and extending fully across the front of the copyboard. A tubular lamp faced the pattern when same was oriented vertically. A rear reflector similar to the front reflector also extended fully across the rear of the copyboard and was provided with its own tubular lamp when same is at its vertical disposition. The reflectors and lamps are assembled mounted between plates or brackets located outside of the support standards provided but quite close thereto. The brackets were coupled to an endless chain driven by a drive motor synchronously operated with the drive motor for the carriage so as to move the light scanning assembly up or down illuminating the copyboard progressively along a band across the front and rear face thereof, depending upon whether one or the other of the lamps are energized.

An optical train was arranged to view the whole field of the copyboard and hence, the subject matter of the original was projected onto a charged electrophotographic member by way of a slit that moves over the sensitive surface of the electrophotographic member in synchronism with the scanning of the original.

The electrophotographic member comprised a flexible article based upon a polyester substrate that is transparent or upon a substrate comprising sheet metal that is not as flexible and opaque, the surface of the electrophotographic member that is exposed to the sweeping light beam comprising in each case a sputtered coating of a wholly inorganic photoconductor that has a crystalline structure and is capable of being rapidly charged, imaged and toned as taught in U.S. Pat. No. 4,025,339. The electrophotographic member of Ser. No. 10,497, now U.S. Pat. No. 4,266,869, was carried on a hinged platen which was located at the top of the enclosure but spaced from the "home" position of the copyboard. The hinging arrangement enabled the user to mount the electrophotographic member horizontally in ambient light and then to rotate the member 180 degrees into an aperture in the enclosure while simultaneously closing the aperture, the photosensitive coating side facing into the enclosure.

The slit was provided in a carriage which carried a charging device, said slit, a toning device and excess toner removal means, all moving together with the carriage across the photosensitive surface of the electrophotographic member in synchronism with the light scanning assembly.

The invention herein relates to improvements in the light scanning assembly which increase the versatility of the plate making apparatus disclosed in said referenced application Ser. No. 10,497, which increases lamp life by enabling improved cooling of the lamps, which provides increased light concentration along a narrow band of the copyboard for improved reproduction of the pattern and reduces light losses by employing focused light beams.

In addition to increasing illumination where opaque originals are scanned, considerable improvement is experienced where the original is transparent and light from the rear or backside is directed through the original in a line always focused in the optical system.

SUMMARY OF THE INVENTION

Accordingly, the invention herein provides a light scanning assembly comprising a fixed lamp pair subassembly and a pivotal single lamp assembly mounted on respective bracket supports to illuminate a selected one of the front and rear faces of the copyboard hereinabove described as during translation of said assembly across the pattern of the original carried by said copyboard when the copyboard is disposed in vertical orientation while the aforementioned processing carriage synchronously is translated across the electrophotographic member.

The fixed lamp pair is arranged spaced and aligned one above the other, each having an eliliptically configured reflector associated therewith for focusing the emitted light to a common band across the width of said copyboard from whence it is viewed by the field of the optical train of said apparatus.

The single lamp is mounted across the rear face of the copyboard and is energized when the original carried thereby is transparent. This single lamp is associated also with an elliptically configured reflector for developing a focused beam directed to and through the copyboard along a line intersecting the center line of the optical lens arrangement comprising the optical train. Bracket means mounting said single lamp and reflector is itself mounted for pivotal rotational movement to the bracket carrying the fixed lamp pair and is pivoted along a predefined arc during translation of the lamps and reflectors across the pattern of the original carried by said copyboard whereby the directed beam continuously follows a straight line always intersecting the center line of the optical lens arrangement at the same location.

The invention there will be described as a light scanning or illuminating assembly for electrophotographic imaging apparatus for making graphic printing plates. An articulated copyboard is mounted between a pair of like upright support assemblies for translation between a horizontally oriented loading condition and a vertically oriented imaging or scanning condition such as discussed in the referenced application. Ser. No. 10,497 now U.S. Pat. No. 4,266,869.

Replacing the two stage tracks of the earlier disclosure, a single uninterrupted track is defined as a continuous groove formed within said support assemblies and a chain drive is accommodated therein. Pins means are secured to said copyboard and are carried by said chain drive, to translate the copyboard from the horizontally oriented loading condition along a first path with its surface horizontal and then along a second path rotated 90 degrees from the first path. A light scanning assembly is provided for scanning movement across the front or rear face of the copyboard illuminating same progressively when the copyboard is oriented vertically. A first or fixed pair of illumination lamps are mounted on a translatable carriage or bracket to direct a common beam of light along a path about one and one-half inches across the facing copyboard, the fixed pair being capable translation fully across the said face synchronously with the processing carriage of said imaging apparatus. The entire front face of the copyboard is viewed by the optical system and the projected image of the pattern directed to the undersurface of a charged electrophotographic member via the slit carried by the carriage. A second lamp is positioned facing the rear of the copyboard. This lamp with its associated reflector, is carried on a pivotable bracket.

The lamp pair are arranged one above the other spaced apart and aligned, including reflectors for each of elliptical configuration, the light from said lamps being directed in a focused beam to illuminate a narrow band across the facing copyboard, an additional lamp and its associated elliptically configured reflector carried on a pivotally mounted bracket for movement through a predefined arc so that the light path is defined along a straight line beam always focused at the optical center of the optical train during full scanning function of the single lamp. Cam means in the form of a wheel, are described secured to the single-lamp bracket acting to follow a canted track formed on said support assembly.

DESCRIPTION OF THE PREFERRED EMBODIMENT

Figure 1:
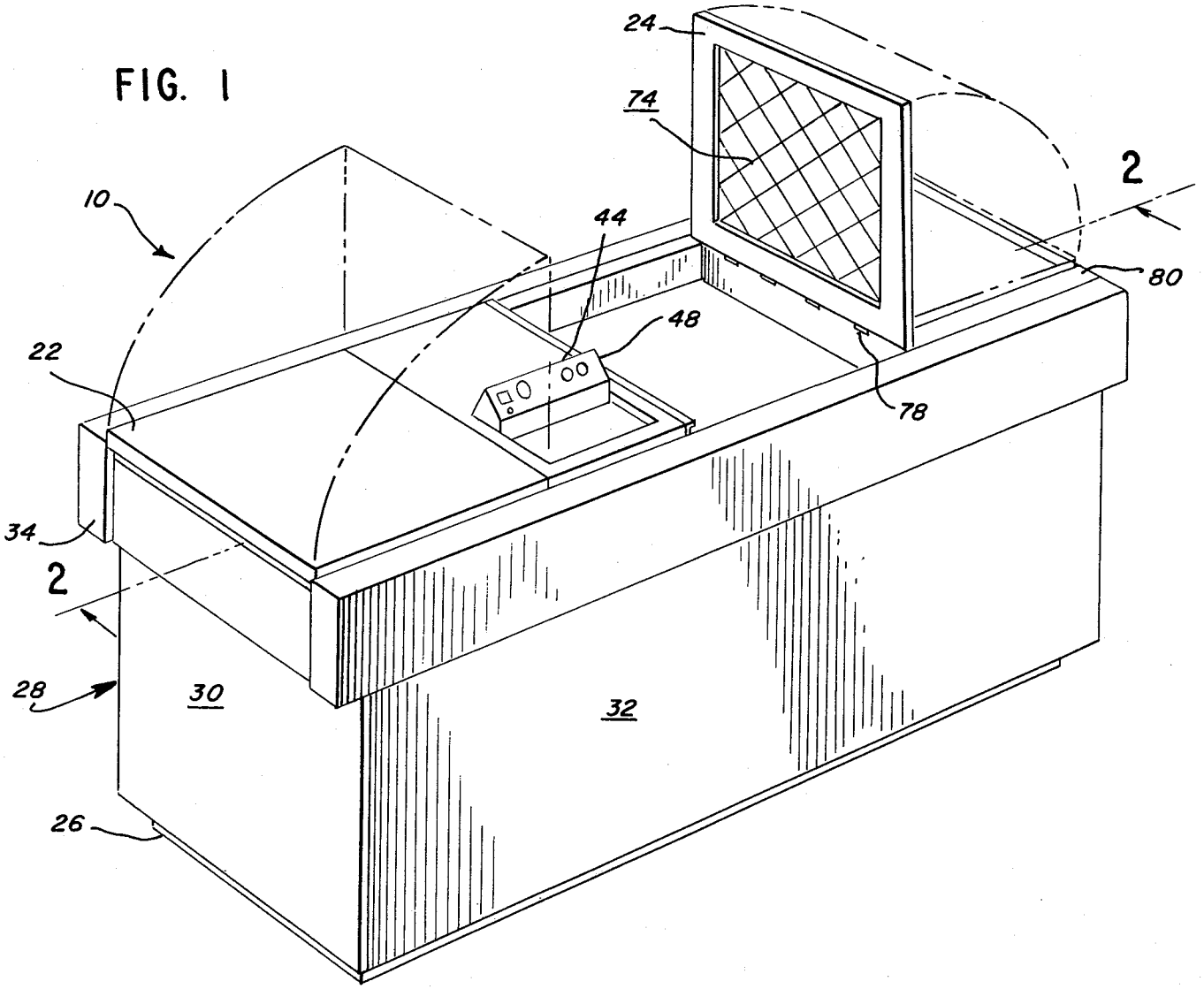
FIG. 1 is a perspective view of the printing plate making apparatus in which the light scanning assembly of the invention is employed.

The apparatus in which the light scanning assembly of the invention advantageously is employed may be considered a camera or projector combined with an electrostatic plate making processor. The camera is invested with the task of responding to the light which is produced by the light scanning system which illuminates a copyboard upon which there has been placed or secured a variegated pattern (original) which it is desired to project onto a surface. The pattern may comprise a single member or multiple members in the form of photographs, drawings, diagrams, text, captions, headings, numerical columns or the like. Opaque, translucent or transparent articles or members are included. These may be clamped between a pair of glass plates into a pair of hinged frames and comprising the copyboard. The plates may be clamped at their entry edges with the frame being provided with registration pins for locating the member thereon.

The copyboard is disposed at one end of the apparatus and is available in a horizontal position when the cover is open. After the pattern carrying member has been inserted between the glass plates, the copyboard is driven from its horizontal position adjacent the top of the apparatus to a vertical position down inside of the apparatus, with the pattern facing the lens system which is provided in the center of the apparatus.

After the copyboard is vertically oriented in position to be illuminated by the light scanning assembly provided by the invention, the operator may move to the opposite end of the apparatus to position and to mount the plate which is to be made carrying the pattern of the material that is carried on the copyboard.

The apparatus has a platen at the end opposite the copyboard which is mounted on the bottom of a hinged cover member. When the cover member is swung open, it exposes the platen which is provided means for holding the plate securely with the photoconductive coating thereof facing outwardly. When the cover member is swung to a closed position it closes off the upperpart of the apparatus near its end. With the photoconductive coating facing inwardly or downward, the optical train including a lens system, is mounted on a partition generally centrally located between the platen end of the apparatus and the copyboard end of the apparatus.

The plate, which is being made, is formed on a rectangular member of electrophotographic material which may be based upon metal or plastic film such as polyester. The operator swings the platen cover open and places the electrophotographic member on the platen. Registration pins may be provided on the platen to assure proper and repeatable orientation and positioning of the member on said platen. When a metal member is employed, the platen may be provided with magnetic means as a part thereof to hold the member securely with the photoconductive coating thereof exposed. The cover member is swung to a closed condition causing the photoconductive surface coating of the electrophotographic member to face downward.

At this point the copyboard is arranged vertically and the photoconductive coating surface is arranged horizontally.

The camera aspect of the apparatus now comes into play. The light scanning assembly provided herein includes a lamp carriage including a mounting for fixedly holding a pair of illuminating lamps and their associated elliptical reflectors on the facing side of the copyboard, and a second, pivotally mounted, lamp and its associated reflector, on the rear side thereof.

The light scanning assembly is driven mechanically along a generally vertical path to scan the copyboard and hence the pattern on its surface from the bottom to the top. The illuminated pattern is viewed as a moving strip or horizontal band by the optical train, the area of the facing copyboard being within the field thereof. The resulting image is projected through the optical train to a pit or chamber whose upper end is closed off by the platen. A diagonal mirror in the wall of the chamber opposite the optical train and below the platen diverts the image so as to project same upward toward the platen.

When the operator starts the automatic aspect of the apparatus, there is a carriage which is normally in its home position beneath the open position of the platen. This carriage includes at its leading edge a high voltage corona device in the form of wires stretching across the width of the carriage normal to the direction of its movement. Preferably, these wires are reciprocated, while energized, according to the teachings of U.S. Pat. No. 4,076,406. Following the corona wires there is a slit which is open through the carriage and which exposes a strip of the photoconductive coating surface of the electrophotographic member as the carriage moves. Next after the slit, there is a wide metal plate which provides a toning bias, and which carries a flowing layer of liquid toner supplied by a sump beneath the plate and brought up to the plate by a roller that is immersed in the sump. Following the roller, there is a slot opening to a vacuum nozzle which sucks excess toner from the toned image on the photoconductive coating surface. An elongate space is defined between the roller and the wall of the toner sump to catch runoff of excess toner. Air under pressure can be expelled against the toned coating surface to drive excess dripping toner into the vacuum slot for drying the toned image.

The carriage and the light scanning assembly move simultaneously synchronously, the light scanning assembly moving from the bottom of the vertically arranged copyboard to its top end and illuminating a narrow band across the pattern progressively simultaneously with the movement of the carriage along the length of the electrophotographic member.

At the end of the movements of the light scanning assembly and the processing carriage, both return to their home positions and the automatically programmed portion of the operation is completed. The various functions of the equipment which are not necessary are turned off and the plate is substantially completed.

The platen cover is now opened, the plate examined and if satisfactory, is removed. It will be fairly dry even without having been subjected to fixing or fusing. This is because of the stream of air flowing from the nozzle. The apparatus is capable of carrying a fusing or fixing device on the carriage or having one located at the end of the forward stroke of the carriage, but it is preferred that the fixing not be complete so that the plate can be corrected by the operator if he desires before fixing.

The operator may leave the copyboard in position vertically if he desires to make another plate of the same pattern or he can throw a switch to bring the copyboard back to its upper horizontal position so that another pattern can be applied thereto after the one in place is removed or modified.

One important feature of the herein apparatus is that the copyboard is a part of a module which is movable along a single continuous track provided on the supporting frame or chassis defining the enclosure of the apparatus whereby properly to focus the projected image upon the plate. The module is self-contained in that it includes the copyboard, the guide means for movement of the copyboard between its horizontal and vertical positions, the drive motor and belts for moving the copyboard, the entire light scanner assembly of the invention with its associated guides and driving motor and drive and means for connecting the module into the entire system such as plugs, connectors and the like. When the module is properly located for the focus that is desired, suitable means are provided to clamp the module to the rails of the framework of the apparatus.

Figure 2:
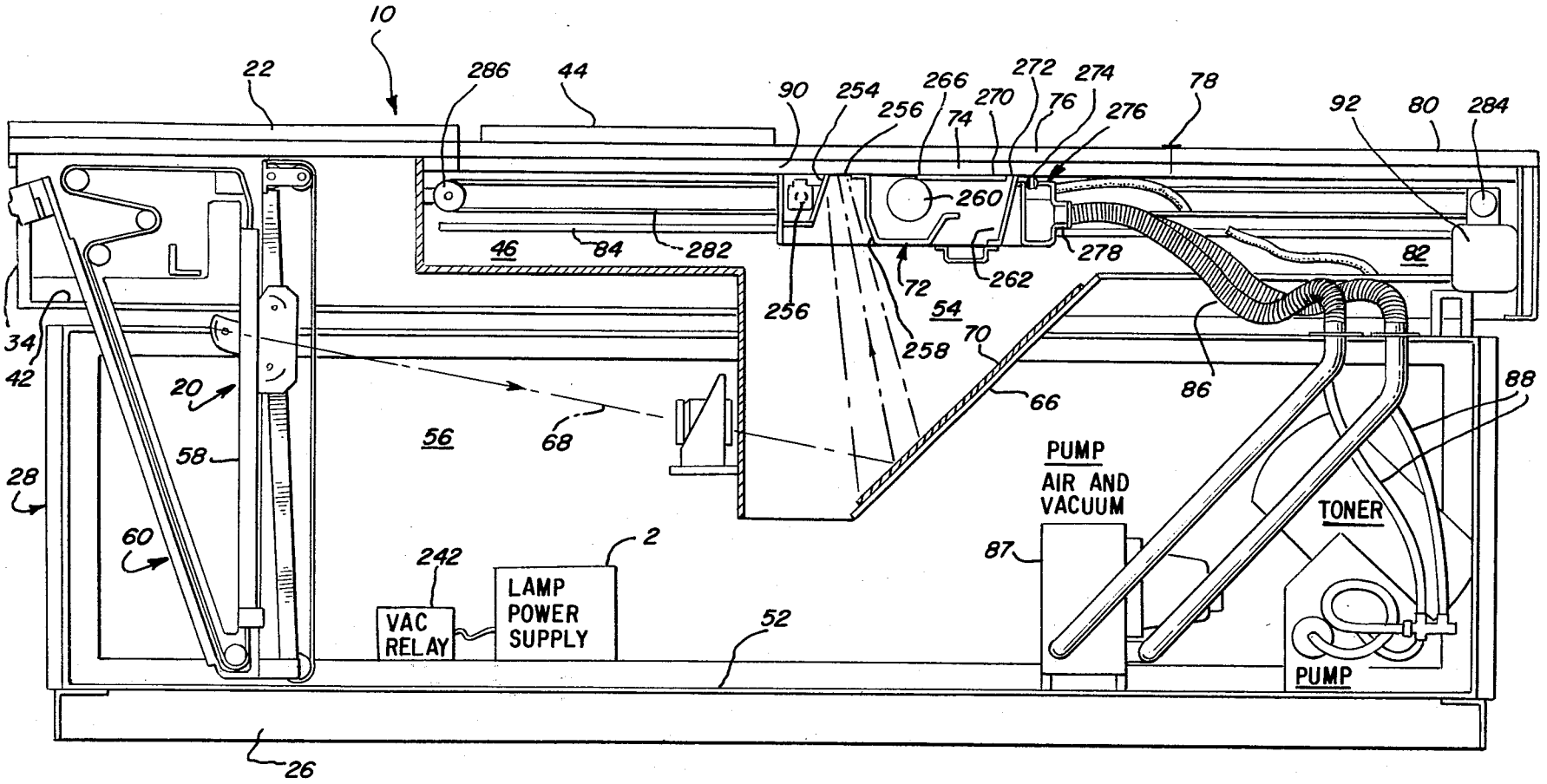
FIG. 2 is a sectional view taken along lines 2—2 of FIG. 1 in the direction indicated, some portions being deleted.
Figure 3:
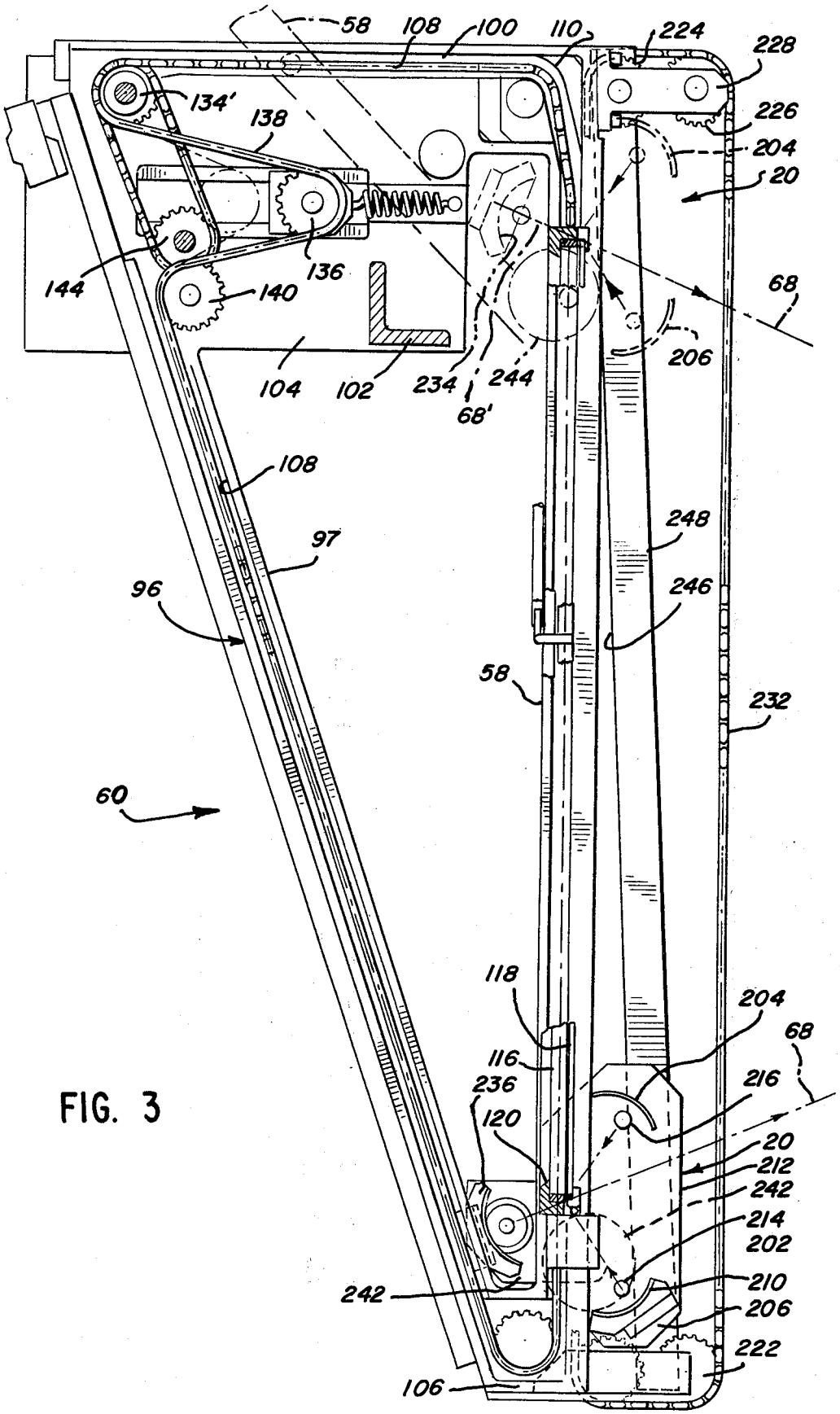
FIG. 3 is a fragmentary perspective view looking downward at the light scanning assembly of the invention installed on the copyboard module of the apparatus illustrated in FIGS. 1 and 2.

Reference may be had to FIGS. 1 and 2 wherein the platemaking apparatus 10 is illustrated having the light scanning assembly advantageously employed therewith designated by the reference character 20. In FIG. 1 apparatus 10 is shown in a condition with the copyboard cover 22 closed and the platen cover 24 half way open. The platemaker apparatus 20 is formed of a bottom pedestal 26 upon which is mounted the main chassis or framework 28. The main chassis is illustrated as a relatively elongate enclosure whose exterior may be ornamental and comprises of panels such as the end panel 30 and the front panel 32. The interior framework will however be formed or robust steel members suitably welded or bolted together to provide a rigid and stable platform for the apparatus 10, considering, of course, that there is included an effective camera with a long focal length and that sharp reproductions of the patterns are desired.

The upper part of the main chassis 28 has a sub-chassis mounted thereon, the sub-chassis being designated generally as 34 in FIG. 1. The sub-chassis 34 includes rails and tracks which are provided for several purposes. Typically, there is a plurality of brackets welded to structural members 37 and having structural rails of the sub-chassis 34 bolted thereto by means of shock mountings (not shown) which may include elastomeric bushings. The structural rails include interior track 42 upon which the copyboard module 60 may be moved and secured.

There is a central cover member 44 on the upper face of the platemaker 20 which remains permanently in place overlying and forming with other structural members, the terminal position chamber 46 of the processing carriage. Reference may be had to FIG. 2 for the relative position of the chamber 46 with respect to the other components of the apparatus 10. The cover 44 is considered to be located to the rear of the apparatus 10 because the operator will stand in front of the apparatus 10 facing the panel 32 or at one end or the other during use of the apparatus.

Forward of the cover 44 and also overlying a portion of the terminal position chamber 46 is an instrument and control panel 48 (FIG. 1) which includes a housing for the gauges and switches required to control and operate the apparatus 10.

There is a central partition or generally vertical wall 50 which extends downward from the chamber 46 toward the bottom floor 52 of the chassis 28, this partition 50 serving as one wall of the projection chamber 54. The wall 50 also separates the copyboard end of the interior of the device from the projection chamber 54, such end being generally referred to as the copyboard projection chamber 56.

The copyboard 58 is disposed in the copyboard chamber 56 and it generally is associated with the copyboard module 60. The copyboard module is in the form of an independent article that can be manufactured separately from the remainder of the apparatus 10 and then incorporated therein. It should be understood that the copyboard 58 need not be incorporated in a module but could be constructed to operate as a permanently connected portion of apparatus 10. As will be explained, the copyboard module 60 is mounted for movement along continuous track 42 and adjusted for proper focus after which it is clamped in place by suitable clamps (not shown).

The central partition or wall 50 serves to support the optical train including lens system 64 by means of which the pattern on the copyboard 58 is projected to the projection chamber 54.

The chamber 54 has a back wall 66 which is arranged at a 45° angle relative to the vertical so that the rays indicated at 68 which originate at the illuminated copyboard 58 will be directed via lens system 64 to a mirror 70 mounted on the interior of said inclined wall 66 and diverted upward to the slit in the carriage 72.

The processing carriage 72 is translatable in a predetermined path for the purpose of imaging the electrophotographic member 74 which is mounted on the platen 76. The platen 24 is hinged at 78 so that it can be swung from a position in which it is folded back upon the top panel portion 80 of the sub-chassis 34 (see the arcuate broken lines of FIG. 1).

The copyboard chamber is normally closed off by the cover 22, that also swings as indicated by the broken lines of FIG. 1.

The carriage 72 moves from its home position in a suitable enclosed chamber 82 upon guides 84 which are mounted to the tracks 42 from its home chamber 82, out over the projection chamber 54 and into the terminal position chamber 46. The carriage 72 is connected to various devices which are mounted in the enclosure of the chassis 28, for the most part disposed on the base 52. Primarily there are flexible hoses 86 connecting to the vacuum and air pressure devices 87 and the toner circulating pipes 88. These may be separate or within one another. Flexible wires connect to sources of power (not shown) located in the body of the apparatus.

The carriage 72 is driven by belts 90 which engage over sheaves 284,286 that are in turn rotated by connection with a motor 92 mounted in the chassis 28. The belts are clamped to the carriage 72.

The principal effect of movement of the carriage 72 is to sweep a slit over photoconductive coating on the face of the electrophotographic member 74. This slit is supplied with illumination derived from the pattern mounted on the copyboard 58.

The copyboard 58 synchronously is strongly illuminated by the lamps of the light scanning assembly provided by this invention, said assembly being translated upward while the carriage is moving from the chamber 82 to the chamber 46.

The copyboard module 60 is constructed as a generally triangular metal frame 96 which fits upon the tracks 42 and can slide thereon for installation. Clamps (not shown) engage the bottom of the tracks 42 to secure the frame in place when the desired location is reached. The frame 96 has a pair of vertically arranged portions 98 which, with horizontal portion 100 and inclined frame 97 form frame 96. A brace 102 is connected between side plates 104 and a bottom connecting member 106 connects the bottom ends of standard portions 98 to define a base.

Each triangular frame 96 is provided with a continuous guide groove 108 that extends along the length of the horizontal member 100, the vertical member 98 and the inclined frame member 97. The groove 108 opens inwardly and is curvilinear around the corners 110. The groove 108 has a generally horizontal portion 112, the curved portion 110 and a vertical portion 114 formed in member 98.

The copyboard 58 comprises a pair of transparent rectangular glass plates 116,118, each set into a metal frame 120 which is hingedly coupled along one edge and clamped at 124. The pattern is formed by the materials which may be adhered to the glass and/or clamped in place by clamping the frames 120 carrying glass plates 116,118 together.

Bridging shaft 132 carries roller bearing sprockets 134,134' at opposite ends, the pair located close to one end of the edge of copyboard 58. A spring biased movable sprocket wheel 136 is provided for applying suitable tension to the sprocket chain 138 mounted on sprockets 134',140. Sprocket wheel 136 is mounted on plate 104.

A drive motor 146 located near the upper corner of the module 60 secured on plate 142 on the inclined frame 97, through reduction gear box 148 drives sprocket wheel 150. Sprocket chain 152 engages the motor output sprocket wheel 144 and driving sprocket wheel 134' located offset from sprocket wheel 134',140. Spring biased bracket 154 is seated in slide 156 and carries tension sprocket 136 to apply sufficient adjustable tension to said chain 138. Chain 138 is coupled to the copyboard by suitable trucks or pins carried by the copyboard frame 120. Energization of motor 146 in one direction will cause the sprocket 138 to be driven in one direction causing the copyboard frame 120 to be driven up and down, changing direction by pivoting about corners 110, provided with nylon or teflon plugs 158 having camlike surfaces 160.

Thus the copyboard 58 will move within the module 60. When the copyboard 58 moves to the vertically oriented position as shown in FIG. 2, it is disposed in condition to be scanned by light scanning assembly 20.

When the copyboard 58 is in its vertical position, the then bottom end of the frame 120 is located at the upper edge of the crossbar 102. Suitable stops are provided accurately to fix the location of the copyboard 58 for accurate projection of the pattern.

The module 60 also carries the light scanning assembly 20 constructed in accordance with the herein invention and whose purpose is to illuminate the pattern on the copyboard 58 progressively as the carriage 72 moves across the projection chamber 54.

The light scanning assembly, designated herein by reference character 20, includes a pair of front reflectors 202 and 204 of elliptical configuration and extending fully across the front face of the copyboard 58. The reflectors 202 and 204 are aligned one with the other in superposed spaced relationship each disposed at an equal but oppositely facing angles relative to the copyboard 58.

The reflectors 202 and 204 are secured to bridging bars 206 and 208 by clamps 210. The bridging bars are in turn secured to brackets 212 at their respective opposite ends.

The tubular lamps 214 and 216 are mounted in fixed array at a location spaced from the respective reflectors 202 and 204 so that the rays of light emitted therefrom as beams intersecting at a common band across the facing copyboard. A suitable shaft is mounted journaled in the brackets 212 at the floor of the enclosure with sprocket wheel 218 secured at the ends thereof. Second sprocket wheels 220 are journaled in bracket 222 spaced from sprocket wheels 218. A pair of upper sprocket wheels 224 and 226 are mounted on upper brackets 228 aligned with each sprocket wheel set 218, 220. The brackets and bridging bar define a light scanning carriage and include pin means represented at 230 coupled to an endless sprocket chain 232 threaded about sprocket wheels 218,220 and 224,226. A separate drive motor 234 is drivably coupled to one set of sprocket wheels for driving the light scanning assembly up or down.

Figure 4:
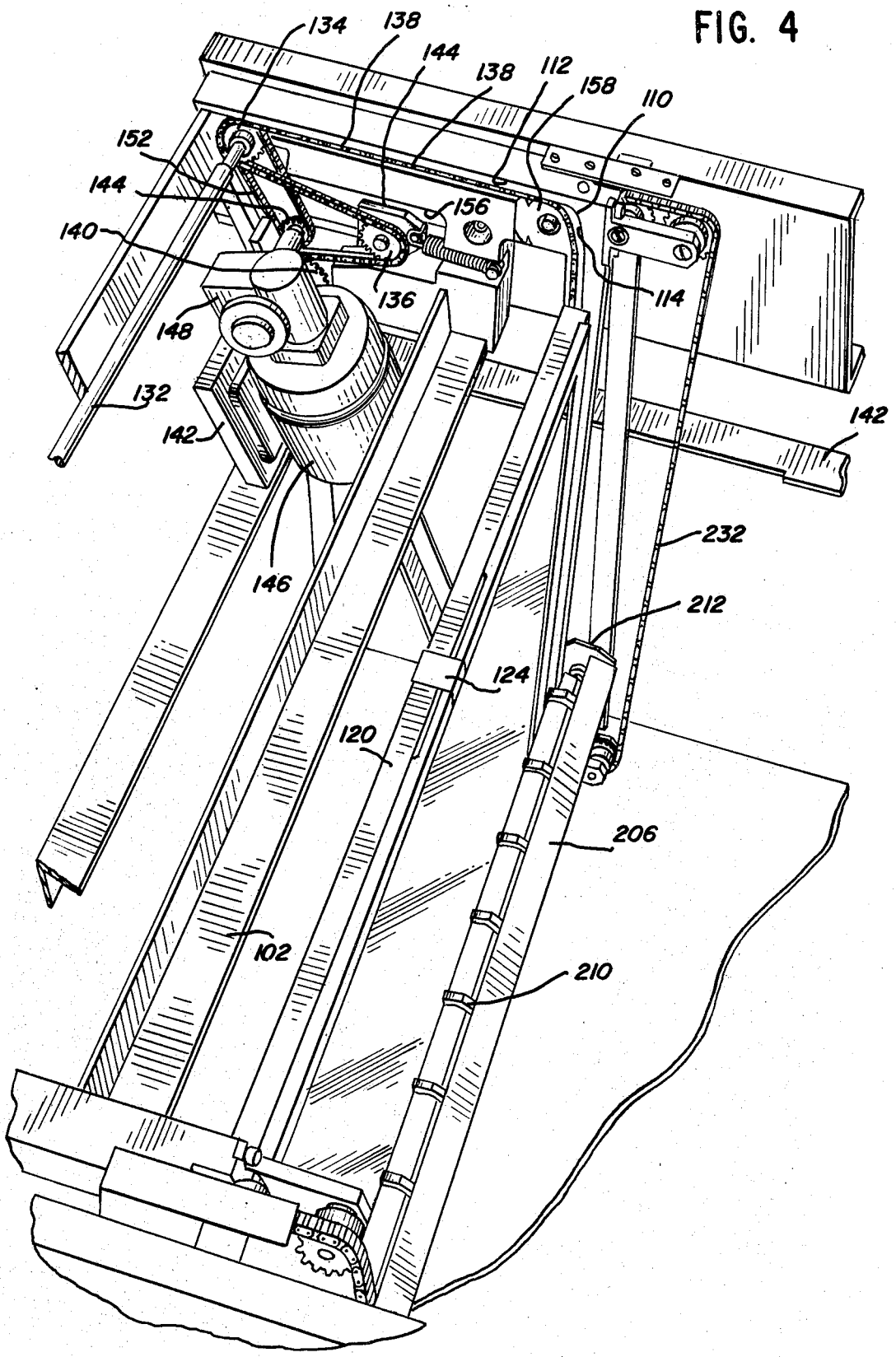
FIG. 4 is an elevational view of the structure shown in FIG. 3.
Figure 5:
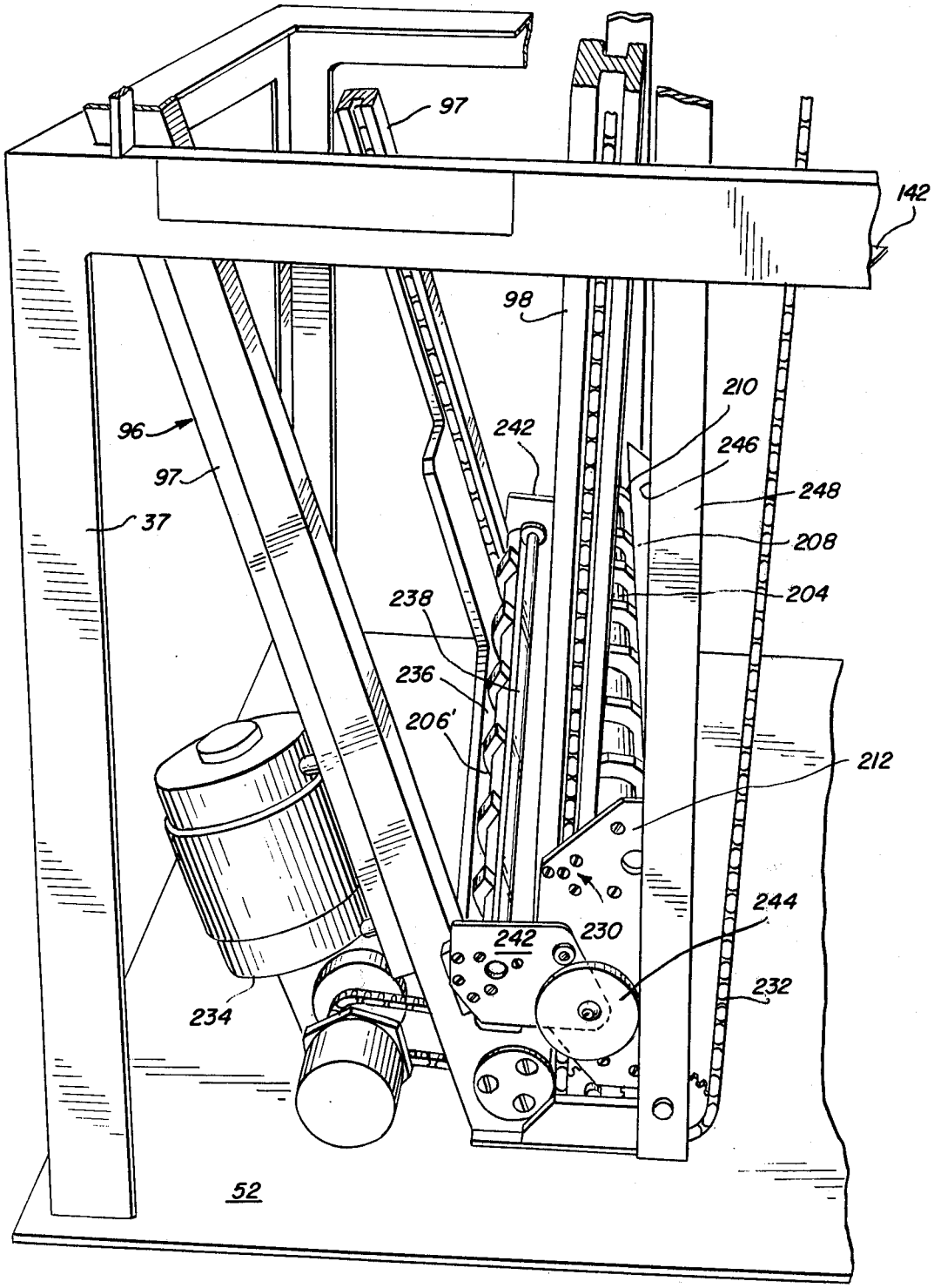
FIG. 5 is a fragmentary perspective generally elevational view of the structure shown in FIG. 3.

The light scanning assembly further includes an additional reflector 236, also of elliptical configuration having associated therewith an illuminating lamp 238. A bridging bar 206' mounts the reflector 236 between a pair of pivotable end brackets 242. A wheel 244 is coupled fixedly to each bracket 242 and follows an inclined track 246 defined along one edge of canted upright 248. Brackets 242 are not spring biased, hence for return to its base condition at the lower end of the vertically oriented copyboard 58, depends only upon their weight to cause such return. The brackets 242 are carried with the travel of the sprocket chain 232 and selectively rotate during the progress upward to direct its beam of light to and through the original and copyboard. Because of the pivoting action through a predetermined arc as shown in bottom outline in FIG. 4, the beam 68' from lamp 238 and reflector 236 always is focused along a straight line direct to the optical center of the lens system, leading into regardless of their location along the copyboard 58.

The connection between lamps 214,216 and 238 to the power supply 250 is taken through vacuum relays 242 to provide additional power to operate the two (fixed) lamp system when the "original" is opaque.

Lamps having illumination characteristics such as Xenon lamps suitable can be used. The lamps are generally open and accessible primarily, for cooling.

The carriage 72 is an assembly which is made of sheet metal and has several important components. At its front end there is an upwardly opening trough 254 which carries corona wires 256 extending along its length, that is, transverse of the direction of movement of the carriage 72. The carriage 72 moves to the right and left as viewed in FIG. 2. The corona wires 256 may be mounted to a reciprocating support as taught by U.S. Pat. No. 3,978,380. Next along the carriage 72 toward the right is a slit 258 or elongate aperture which opens to the top of the carriage 72, and is intended to sweep across the electrophotographic member or plate 74 as it can be called, in synchronism with the movement of the light scanning assembly 20 in order to expose said plate 74 progressively. It will be seen that the entrance to the slit 256 is tapered, the taper being indicated by the walls 258 so that the rays of light reflected from the mirror 70 will be unobstructed in impinging against the plate surface.

Following the slit 246, there is a sump 262 into which liquid toner is being pumped, there being a large roller 260 rotating in the sump 262 and carrying liquid toner out of the sump to the upper exposed surface of the roller 264. At the upper side of the roller 264 there is a sharp edge 266 that is spaced very close to the roller surface to enable a thick layer or wall of toner carried by the roller 260 to be captured and swept across the upper surface of a flat plate 270 that follows the roller 264. This plate 270 is insulatedly mounted and has a toning electrical bias voltage applied thereto by suitable electrical connections (not shown). The toner flows across the face of the plate 270 in a direction opposite the movement of the carriage 72 during the making of the plate, and drops down behind the plate at the opening 272 into the sump 262.

The movement of the carriage carries the toner on the plate 270 close enough to the bottom surface of the electrophotographic member so that toning will take place. When dry, the plate 270 is spaced from the electrophotographic member 74. Excess toner will be drawn into gap 272 to return to sump 262. Adjacent gap 272 is the narrow mouth 274 of a vacuum knife 276 communicating with vacuum nozzle 278 for sucking excess toner from the photoconductive surface of the electrophotographic member 74 while the carriage 72 traverses same.

The carriage 72 can include side blocks (not shown) that engage upon interior guide rods 84 which are mounted to the tracks 42. A suitable drive motor 280 drives the belt 282 extending parallel along the tracks 42 made by socket wheels 284 and 286.

The carriage 72 is connected by pipes, conduits and wire to the various sources of voltage, storage and pumping of toner, air and vacuum, etc.

It has been found that the radiant energy distribution projected to the photoconductive coating surface of the electrophotographic member is variable due to losses believed due to lens aberation of the optical system, illumination intensity variations across the copyboard and from side to side of the copyboard.

Variations are capable of being made without departing from the spirit or scope of the invention as defined in the attached claims.

What is desired to secure by Letters Patent of the United States is:

1. In apparatus, including a chassis enclosure in which a copyboard and a platen is arranged, for producing a toned image on an electrophotographic member carried by the platen for the purpose of making said member into a graphic arts printing plate directly from a pattern carried by the copyboard, the electrophotographic member being mountable on the platen with the photoconductive coating surface exposed, the copyboard being arranged for progressive illumination thereacross cooperating with a fixed optical system for directing radiant energy in the form of light from the pattern to the exposed photoconductive coating surface continuously and in synchronism with the movement of a carriage in one direction wherein the carriage carries charging means, a slit and toning means arranged in that order, the carriage constructed to obstruct the exposed photoconductive coating surface from said radiant energy when moving in said one direction but for the slit; light scanning assembly means for progressively illuminating the pattern on the copyboard with radiant energy; the improvement comprising first and second illuminating lamp means, a bracket plate assembly for mounting said first and second illuminating lamp means transverse to the copyboard superposed, aligned, spaced one above the other and in scanning condition relative to the pattern carried by said copyboard and drive means for progressively moving said bracket plate assembly and lamp means synchronously with the carriage, each said lamp means having reflector means associated therewith and arranged in relationship thereto so as to form a beam of radiant energy directed toward the said pattern, the pair of resulting beams intersecting at the pattern for illuminating same, said lamp and reflector means being pivotably mounted for limited rotation along a predetermined arc during movement of said assembly and lamp means transverse the pattern whereby to maintain the intersecting relationship for the full traversal of said copyboard, with the beam of radiant energy formed thereby directed along a line of sight which is the shortest distance from the lamp to the said central axis continuously intersecting the same point on the central axis of the fixed optical system throughout travel of said assembly across the copyboard.

2. The combination as claimed in claim 1 in which said pair of first and second lamp means is arranged facing one side of said copyboard and said light scanning assembly further comprises third illuminating lamp means, said third lamp means arranged facing the opposite side of said copyboard and arm bracket means carrying said third lamp means and mounted for pivotal movement on the bracket plate assembly for movement along said copyboard therewith, cam means carried by said arm bracket means and cooperating track means associated therewith along the path of movement of said bracket plate assembly, said third lamp means having associated reflector means to form a beam of radiant energy directed through said copyboard along a line leading directly to the central axis of the fixed optical system, said third lamp and reflector means also being pivotable for limited rotation along a predetermined arc during progressive movement of said bracket plate assembly with the beam of radiant energy formed thereby directed along a line of sight which is the shortest distance from the lamp to the said central axis continuously intersecting the same point on the central axis of the fixed optical system throughout travel of said assembly across the copyboard.

3. The apparatus as claimed in claim 1 in which said reflector means comprise a reflector of elliptical configuration.

4. The apparatus as claimed in claim 2 in which the said reflector means comprise a reflector of elliptical configuration.

5. The combination as claimed in claim 1 in which said first and second illuminating lamp means is enabled during the movement of said light scanning assembly upward from the initial to the final position and is disabled during movement downward from the final to the initial position.

6. The combination as claimed in claim 5 in which there are first and second power supply circuits, one of said circuits arranged for operating one of said first and third illuminating lamp means and said other power supply circuit means arranged to operate said second illuminating lamp means only during operation of said first illuminating lamp means.

7. The combination as claimed in claim 2 in which said first and second illuminating lamp means is enabled during the movement of said light scanning assembly upward from the initial to the final position and is disabled during movement downward from the final to the initial position.

8. The combination as claimed in claim 1 in which the said reflectors are elliptical in configuration.

9. The combination as claimed in claim 2 in which said cam means comprise a wheel and said track means comprises an inclined portion along one of the vertical standards.

10. The combination as claimed in claim 1 in which the copyboard is disposed vertically during operation of said light scanning assembly, the enclosure has a top opening in the vicinity of the copyboard, means are provided for moving the copyboard between said vertical position and a position in which it is substantially horizontally arranged at least adjacent if not within the enclosure top opening so that it is available for mounting said pattern by an operator prior to imaging, said copyboard moving means including a framework connected with said enclosure on the interior thereof and the framework and copyboard having cooperating follower and guide means and drive means coupled with said follower and guide means, said guide means comprises a continuous groove formed in said framework.

11. The combination as claimed in claim 8 in which said drive means comprises a motor having an output shaft, an endless chain coupled to the shaft, said chain seated with said groove and said follower comprising coupling means secured to said copyboard and coupled to said chain.

12. The apparatus as claimed in claim 10 in which said framework includes a pair of vertical standards integral therewith including a horizontal portion and a vertical portion and stationary bearing means at the juncture of the vertical and horizontal portions.

13. In a method of imaging an electrophotographic member from a pattern which is carried on a copyboard, the electrophotographic member being mounted on the surface of a platen, which includes the steps of disposing the platen to face downwardly so that the electrophtographic member is exposed downwardly, disposing the copyboard vertically to face horizontally, generally toward a vertical axis generally normal to the center of the platen, providing a carriage which has charging means, a slit and toning means, passing the carriage across the bottom face of the platen to block light directed upward toward the electrophotographic member but for the scanning action of the slit, moving a source of radiant energy illumination in a vertical direction over the surface of the copyboard substantially in synchronism with the movement of the carriage while energizing said charging means and toning means, projecting the portions of the copyboard illuminated by said source of radiant energy illumination through a fixed optical system horizontally toward said vertical axis below said carriage and deviating the projected portions upward toward said electrophotographic member progressively to image the electrophotographic member on said platen with whatever pattern is carried on said copyboard, the improved method comprising the additional step of carrying out the illumination by directing a pair of linear like beams toward the copyboard for intersection at a common band thereacross by pivoting the lamps along predetermined arcs to direct the beams to intersect along a line which is at the shortest distance to the center of the optical system simultaneous with the progressive movement of said source transverse the copyboard.

14. The method as claimed in claim 13 in which the copyboard is transparent and the rear of the copyboard is illuminated by directing a focused third beam of light therethrough from a source thereof, the latter source being pivoted during movement of said latter source in a vertical direction over the surface of the copyboard to direct the focused beam continuously indirectly to the center axis of the fixed optical system, the source of radiant energy for the pair of linear like beams being inoperative during operation of the source of said third beam.

15. The method as claimed in claim 14 in which either the front or the rear of the copyboard is illuminated.

16. In apparatus for producing a toned image on an electrophotographic member directly from a pattern of the type including a chassis having a copyboard capable of mounting a pattern and a platen capable of carrying an electrophotographic member with the photoconductive surface thereof exposed, and mounted for movement between a loading condition facing outwardly of the chassis and a horizontal imaging condition facing inwardly of the chassis, the pattern on the copyboard being progressively illuminated and the radiant energy from the pattern being directed by optical lens means to the exposed photoconductive surface by way of a carriage mounted in the chassis and enclosed normally from ambient light, the carriage being movable across the photoconductive surface simultaneously with illumination of the copyboard, the carriage carrying charging means, a slit and toning means arranged in that order, the carriage obstructing the photoconductive surface from said projected radiant energy when it is moving but for the slit, the carriage being driven in a first direction horizontally across the photoconductive surface between a home and a terminal position during an imaging stroke and returned to home position in a return stroke, the invention comprising a movable scanning assembly comprising first radiant energy source means and second radiant energy source means carried on the assembly, drive means for moving scanning assembly from an initial position to a final position scanning the copyboard and any pattern thereon while energizing said radiant source means and for returning said assembly from the final position to the initial position while disabling the radiant energy source means, said first radiant energy source means comprising a pair of illuminating lamps and a pair of associated focusing reflectors, one reflector associated with one lamp, bracket plate means mounting said lamps and associated reflectors one above the other spaced apart and arranged to define a pair of converging radiant energy beams intersecting at the copyboard, said lamp and reflector pair each being simultaneously pivotable along a limited arc to maintain a line of intersection at a location spaced the shortest distance to the optical lens means during both imaging and return strokes.

17. The apparatus as claimed in claim 16 in which said second radiant energy source means is disposed facing the side of said copyboard opposite from the first radiant energy source means and comprise a third illuminating lamp and associated focusing reflector arranged mounted for limited pivotal movement along a predetermined arc simultaneously with movement of said scanning assembly from said initial to final positions whereby to direct a focused beam through the copyboard continuously along a direct line to the center line of the said optical leans means during movement of said scanning assembly along its path to its final position regardless of the position of the said assembly relative to said copyboard.

* * * * *